United States Patent [19]

Beijen

[11] 3,968,919

[45] July 13, 1976

[54] METHOD OF FORGING A SOLID HEAD ON A HOLLOW STEEL TUBE

[75] Inventor: James H. Beijen, Glenwood, Ill.

[73] Assignee: Fabsco Corporation, Lansing, Ill.

[22] Filed: Apr. 2, 1975

[21] Appl. No.: 564,286

[52] U.S. Cl. ..... 228/153

[51] Int. Cl.[2] ..... B21J 5/00

[58] Field of Search ..... 228/153, 154, 135, 136, 228/141

[56] References Cited

UNITED STATES PATENTS 845,492 2/1907 Towers ..... 228/154

*Primary Examiner*—Al Lawrence Smith
*Assistant Examiner*—Margaret Joyce
*Attorney, Agent, or Firm*—Dominik, Knechtel, Godula & Demeur

[57] ABSTRACT

A method of forging a solid flanged head on a hollow steel tube by positioning a cylindrical steel plug within a steel tube of the same grade, and extending said positioned cylindrical plug beyond the end of the tube, thereafter heating the end of the tube and plug beyond the critical temperature of the steel material, and thereafter forging the softened material so that a solid steel head is formed which extends beyond the continuous wall of the steel tube.

3 Claims, 3 Drawing Figures

METHOD OF FORGING A SOLID HEAD ON A HOLLOW STEEL TUBE

This invention relates to a method for forging a flanged head on the end of a tube by utilizing the step of inserting a cylindrical plug in the end of the tube.

Figure 1:
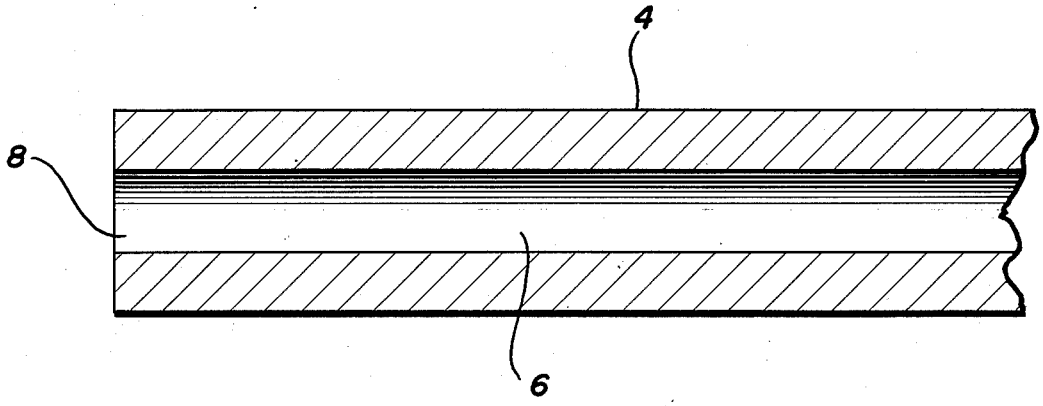
FIG. 1 is a longitudinal sectional view, in portion, taken along the longitudinal plane of a cylindrical tube.
Figure 2:
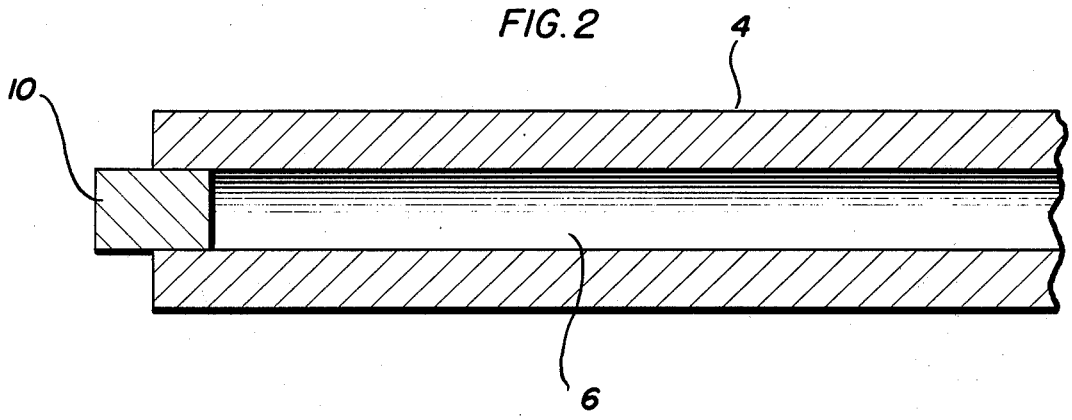
FIG. 2 is a sectional view similar to that of FIG. 1 but illustrating a first stage of the process wherein a cylindrical plug is mounted in extending relationship in the end of the tube.
Figure 3:
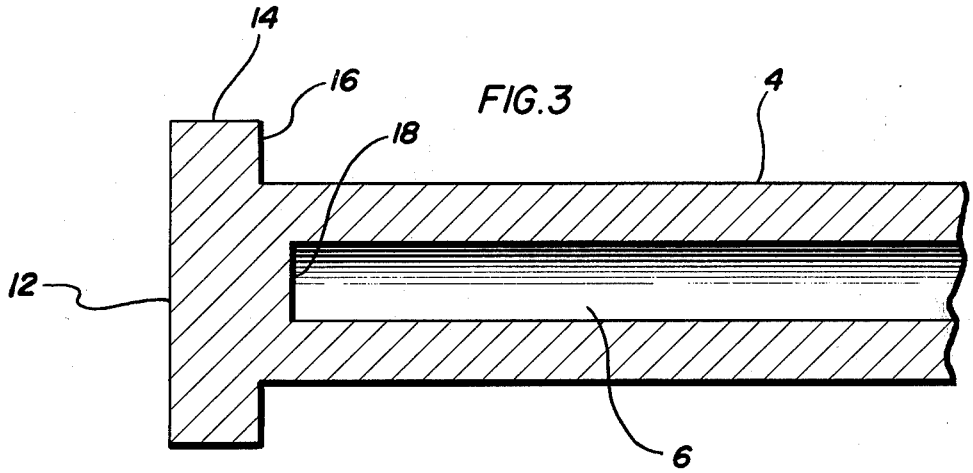
FIG. 3 is a view similar to FIGS. 1 and 2, but illustrating the final stage in the process wherein the end of the tube has been heated and forged to form the solid head.

The drawings illustrate a cylindrical tube having a continuous sidewall 4 enclosing an elongated passageway 6 between oppositely open ends, one of which is indicated at 8. A selected length of tube is used, and is obtained by sawing, cutting or the like. The stage in the process illustrated in FIG. 2 represents frictionally inserting a cylindrical plug 10 into the open end 8 of the passageway 6. The frictional mounting holds the plug in the open end of the passageway in extending relationship. A substantial portion of the axial length of the cylindrical plug should extend from the open end, and even a major portion of the axial length may extend therefrom.

The end of the tube with the mounted cylindrical plug is then heated beyond the critical temperature of the steel which comprises the plug and tube. The end of the softened tube is then forged to form the solid head having a flat bottom 12 and an oppositely flat and continuous shoulder 16 between the continuous wall 4 of the tube and the continuous sidewall 14 of the head which is formed generally on a radius. The head is therefore integrally formed with the tube and the bottom 18 of the plug body is shown spaced inwardly from the continuous shoulder 16 so that a substantial mass is between surfaces 12, 18 to increase the strength of the formed head on the tube.

The claims of the invention are now presented, and the terms of such claims may be further understood by reference to the language of the preceding specification and the views of the drawing.

What is claimed is:

1. A method for making a forged stopper rod having an integrally formed head of steel on one end of a cylindrical steel tube which includes the steps of selecting a length of hollow steel tubing, frictionally inserting a cylindrical steel plug of the same grade steel as the steel tube into an open end of the tube so a body portion of the cylindrical plug enters and is frictionally held within the passageway of the tube and a substantial body portion of said cylindrical plug extends beyond the end of the tube, heating the end of the tube with the extending cylindrical plug beyond the critical temperation of the steel of the plug and tube, and forging the softened cylindrical plug at the end of the tube to form a flattened flanged head integral with the tube.

2. A method which includes the steps of claim 1 above wherein the bottom of the flanged head is forged substantially flat and the opposite continuous shoulder portion of the flange head is forged substantially flat, and wherein a continuous sidewall of the flanged head is forged so that said sidewall is formed along a substantially continuous radius.

3. A method which includes the steps of claim 2 above wherein the bottom of the plug body is spaced inwardly of the continuous shoulder portion of the flanged head providing a substantial mass therebetween.

* * * * *